United States Patent [19]

Bourolleau

[11] Patent Number: 4,630,025

[45] Date of Patent: Dec. 16, 1986

[54] SMALL-SIZED PRECISION HIGH-VOLTAGE RESISTOR IN THICK-FILM TECHNOLOGY

[75] Inventor: Joël Bourolleau, Toulouse, France

[73] Assignee: Renix Electronique, Toulouse, France

[21] Appl. No.: 721,780

[22] Filed: Apr. 10, 1985

[30] Foreign Application Priority Data

Apr. 10, 1984 [FR] France ..... 84 05621

[51] Int. Cl.[4] ..... H01C 1/012; H01C 10/00

[52] U.S. Cl. ..... 338/309; 338/308; 338/195

[58] Field of Search ..... 338/195, 201, 202, 308, 338/309, 334; 29/620

[56] References Cited

U.S. PATENT DOCUMENTS 1,068,907 7/1913 Kraeuter et al. ..... 338/334 X

*Primary Examiner*—E. A. Goldberg
*Assistant Examiner*—Linda M. Peco
*Attorney, Agent, or Firm*—Oblon, Fisher, Spivak, McClelland, & Maier

[57] ABSTRACT

Precision high-voltage resistor comprising a plane substrate of insulating material (1) on which there has been deposited by silk-screening at least one resistive film (3) of approximately rectangular, square or similar shape and a conductive film in the form of two parallel strips (2*a*, 2*b*) extending along two opposite edges of the resistive film and constituting terminals electrically connected to one another by said resistive film, the resistive film comprising rectilinear cuts (5*a* to 5*f*) made in its thickness, down to the insulating substrate, parallel to said opposite edges from a third edge (6) of the resistive film, characterized in that the rectilinear cuts (5*a* to 5*f*) are evenly spaced along the third edge (6) and have lengths that are larger the closer they are to the center of the third edge (6), the ends opposite the third edge (6) of the rectilinear cuts defining from the intersections (8*a*, 8*b*) of the third edge (6) with the terminals (2*a*, 2*b*) a contour (7; 9) exhibiting an apex in its center part.

5 Claims, 8 Drawing Figures

FIG.1 PRIOR ART
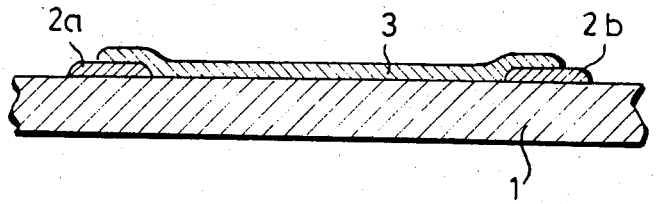
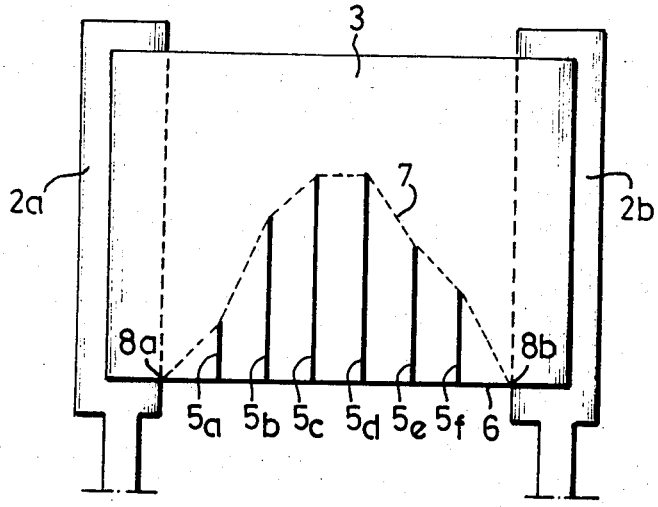
FIG.3
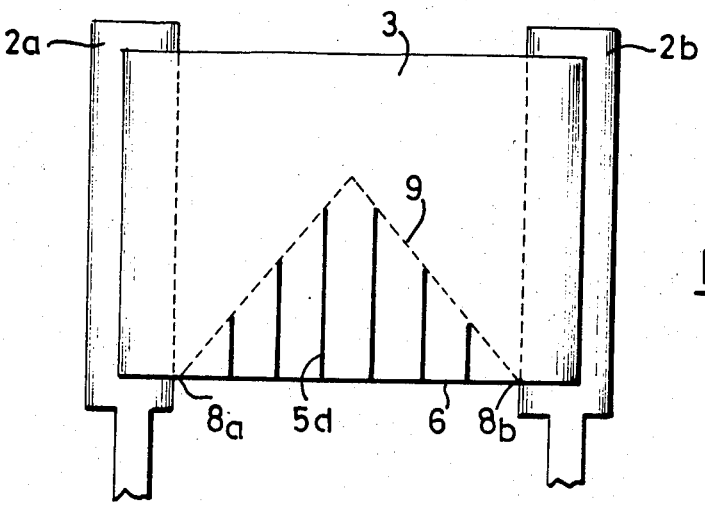
FIG.4

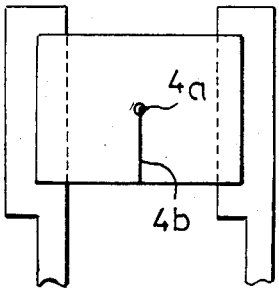
FIG.2A PRIOR ART
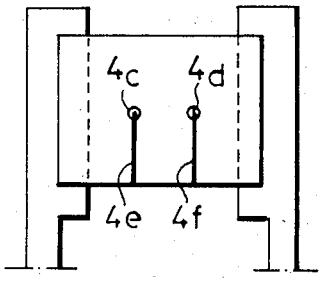
FIG.2B
PRIOR ART
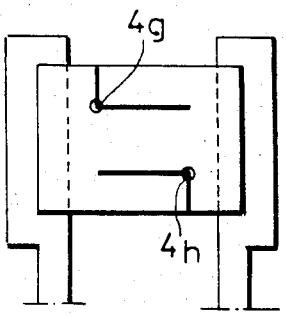
FIG.2C
PRIOR ART
FIG.2D
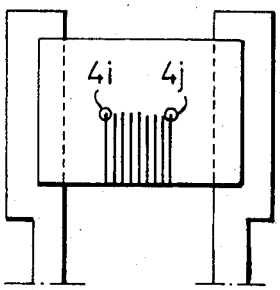
PRIOR ART
FIG.2E
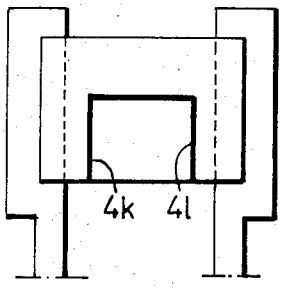
PRIOR ART

SMALL-SIZED PRECISION HIGH-VOLTAGE RESISTOR IN THICK-FILM TECHNOLOGY

BACKGROUND OF THE INVENTION

This invention relates to a resistive circuit element made according to the so-called "thick-film" technology by superposition of two films, one conductive, the other resistive, to obtain a resistance that withstands strong voltages and that is brought to a precise ohmic value by several laser cuts correctly distributed in the resistive film.

"Thick-film" hybrid technology has as its principal base materials resistive, conductive and insulating inks. These inks are in the form of pastes that contain the following elements: special powdered glass, pulverulent precious metals, organic binder, diluent consisting of a mixture of solvents. These ingredients which are mixed to form a thick paste are deposited on ceramic plates called substrates, generally of alumina, by the process of silk-screen printing. Once the paste is deposited on the substrate, the piece is dried at 100°–150° C. to remove the solvents from it and fired in a furnace at 500°–1,000° C., generally 850° C. During the firing, three phenomena occur: breakdown of the organic binder, sintering of the glass particles on the surface of the substrate and vitrification of the unit. Thus, the elements that make up the circuit adhere very strongly to the ceramic.

A resistor made in "thick-film" hybrid technology is shown in FIG. 1 of the accompanying drawings. It comprises two different films deposited on a substrate 1: the first 2*a*, 2*b*, made of a silk-screened conductive ink, dried and optionally fired, serves as a support and as terminals for the resistor; the second 3, made of a silk-screened resistive ink, dried and fired, is in itself the actual resistor. These two films, if the method of manufacturing allows it, can be co-fired, i.e., fired together.

This technology makes it possible to make resistors in a very wide value range ($10$–$10^6$ Ω) depending on the choice of the type of resistive ink used and on the variation of the geometry of the printed resistors.

The materials going into the composition of the conductive ink for the conductive film have a base of metals or alloys such as silver, palladium, platinum, gold, copper, aluminum. The choice of these various metals rests on several criteria: solderability, resistance to aging, definition for printing, low resistivity, adherence to the substrate, compatibility with the resistive ink used and possibility of annealing. The thickness of the conductive film is generally between 5 μm and 50 μm.

The most used materials going into the composition of the ink for the resistive film are metal oxides such as ruthenium oxide or pyrochlores such as thallium ruthenate, whose principal parameters are resistivity, heat variation coefficient, stability over time. The thickness of the resistive film is generally between 10 and 30 μm.

This "thick-film" hybrid resistor can be adjusted by means of a medium-power (0–5 watts) laser beam. This technology of laser cutting consists in vaporizing the resistive materials by creating high intensity coherent light pulses of short duration. A series of laser pulses that more or less overlap creates a narrow groove (on the order of 50 μm) that goes through the resistive film to the substrate and thus cuts the resistor. This cut deflects the lines of current that go through the structure, thereby increasing its ohmic value, and the totality of the voltage applied to the resistor is found on both sides of the laser groove.

The two major problems encountered with this type of cutting for high-voltage resistors are therefore the creation of one or more hot spots accompanied by microcracks at the top of the cutting or cuttings where the concentration of the lines of current are located, and the appearance of an electric arc while operating, from one edge to the other of certain laser cuts when the electric field exceeds a certain limit (on the order of 3,000 v/mm in dry air).

FIGS. 2A and 2E of the accompanying drawings show several forms of cuts which were the object of experimental tests on small-sized "thick-film" hybrid resistors subjected to voltages of several hundred volts. These forms of cuts have proven unsuitable because there resulted either the creation of hot spots at 4*a*, 4*c*, 4*d*, 4*g*, 4*h*, 4*i*, 4*j*, or too strong a voltage gradient between the two edges of the laser groove marked 4*b*, 4*e*, 4*f*, 4*k*, 4*l*, that could cause a poor stability or the destruction of the resistor, by appearance of an electric arc.

With these forms of cuts, said problems can be solved only by oversizing the resistor, which is not always compatible with the installation capabilities offered and increases the manufacturing costs.

SUMMARY OF THE INVENTION

Accordingly, one object of this invention is to provide a novel high-voltage resistor made according to the "thick-film" hybrid technology, whose precise adjustment to the desired value is provided by way of cuts made in the thickness of the resistive film in a configuration which makes it possible to increase the voltage strength of the resistor despite the minimal sizing of the resistor.

For this purpose, the invention has as its object a precision high-voltage resistor comprising a plane substrate of insulating material on which there have been deposited by silk-screening at least one approximately rectangular, square or similar resistive film and one conductive film in the form of two parallel strips extending along two opposite edges of the resistive strip and constituting terminals connected electrically to one another by said resitive film, the resistive film comprising rectilinear cuts made in its thickness, up to the insulating substrate, and parallel to said opposite edges from a third edge of the resistive film, characterized in that the rectilinear cuts are evenly spaced along the third edge and have lengths that are larger the closer they are to the center of the third edge, the ends opposite the third edge of the rectilinear cuts defining, from the intersections of the third edge with the terminals, a contour exhibiting an apex in its center part.

Preferably, the contour is approximately symmetrical in relation to an axis parallel to the terminals and passing through the center of the third edge.

According to a characteristic of this invention, the length of the rectilinear cuts is directly a function of the distance that exists between the adjacent terminals and the cut under consideration.

According to another characteristic of this invention, said contour exhibits the shape of an isosceles triangle whose base coincides with the third edge and whose two equal sides extend from the intersections of the axis of symmetry.

According to yet another characteristic, one of the cuts that imparts to the resistor its definitive value exhibits such a length that its end opposite the third edge does not necessarily coincide with said contour.

BRIEF DESCRIPTION OF THE DRAWINGS

Other characteristics and advantages of the invention will come out of the following description, made with reference to the accompanying drawings given solely by way of example and in which:

FIG. 1 is a view in section of a resistor made according to the "thick-film" hybrid technology;

FIGS. 2A to 2E are plan views showing various configurations of cuts according to the state of the art for the precise adjustment of resistors of the type of FIG. 1;

FIG. 3 is a view similar to FIGS. 2A to 2E showing a configuration of cuts according to the invention; and FIG. 4 is a view similar to FIG. 3 showing a variant embodiment for a configuration of cuts according to the invention.

DESCRIPTION OF THE PREFERRED EMBODIMENTS

The "thick-film" hybrid resistor, as shown in FIG. 3, comprises a resistive film 3 of rectangular shape (a square shape or an approximately polygonal shape may also be employed) deposited on an insulating substrate (not shown), for example of ceramic with an alumina base. Two opposite edges of resistive film 3 overlap a conductive film that is in the shape of two parallel strips *2a, 2b* constituting the terminals of the resistor.

The precise adjustment of the resistor to the desired value is provided by cuts *5a* to *5f* made in the thickness of the resistive film 3 up to the insulating substrate. These cuts are directed parallel to terminals *2a* and *2b* and extend from other third edge of resistive film 3 perpendicular to terminals *2a, 2b*. Rectilinear cuts or grooves *5a* to *5f* have lengths gradually increasing from the terminals to the center of third edge 6, so that their ends opposite this edge 6 define an enclosure or contour 7 that extends from intersections *8a, 8b* of reference edge 6 with films *2a, 2b* while exhibiting an apex in its center part. Preferably, rectilinear cuts *5a* to *5f* are evenly spaced along reference edge 6 and are made by a laser beam as previously described.

As a result of this configuration of the cuts, a distribution of the equipotentials is obtained along the resistor so that, on the one hand, the voltage gradient on both sides of the end of each laser groove is less than a value allowing the creation of an electric arc and so that, on the other hand, the areas where the voltage gradients are strongest are located at the bottom of the longest laser grooves (those near the axis of symmetry of the resistor), the access paths to these areas being very long and consequently sufficiently resistant to prevent the feeding of current for an electric arc.

FIG. 4 shows an alternate embodiment of this invention in which the enclosure or contour defined by the ends of the cuts and the reference edge is triangular. The lengths of the cuts are directly functions of the gap that exists between adjacent terminal *2a* or *2b* and the cut under consideration, so as to be nearly evenly and symmetrically decreasing from an axis that divides into two equal parts the length of resistive film 3.

However, it should be noted that the last cut imparting the desired precision to the resistor can have a length that does not coincide with the outline of triangular contour 9.

Experimental tests have been performed on a 10 k Ω resistor 2.9 mm long and 2.7 mm wide made with a resistive ink of 10 k Ω/□. This resistor was supposed to be adjusted with a precision of 1% and supposed to be able to withstand 400 v pulses for 100 μs between its two terminals. These tests showed that the configuration of the cuts according to the invention made it possible to meet these requirements whereas this was not the case with a resistor built according to the configurations of FIGS. 2A to 2E.

The choice of a small-sized resistor with a cut configuration according to the invention rather than an oversized resistor with, for example, two straight cuts offers, among other things, advantages in production cost due to the low cost of material and of a miniaturization of the structure that is reflected by a savings in installation.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A precision high-voltage resistor comprising:

a plane substrate of insulating material a resistive film deposited by silk-screening on said plane substrate of an approximately rectangular shape; and a conductive film in the form of two parallel strips extending along two opposite edges of the resistive film and constituting terminals electrically connected to one another by said resistive film, wherein the resistive film has rectilinear cuts made in its thickness, down to the insulating substrate, parallel to said opposite edges from a third edge of the resistive film, characterized in that the rectilinear cuts are evenly spaced along the third edge and have lengths that are longer the closer they are to the center of the third edge and wherein the ends opposite the third edge of the rectilinear cuts defining from the intersections of the third edge with the terminals, a contour exhibits an apex in its center part.

2. A resistor as in claim 1, wherein the axis formed by said rectilinear cuts is approximately symmetrical in relation to an axis parallel to the terminals and that said contour passes through the center of the third edge.

3. A resistor as in claim 2, wherein the length of the rectilinear cuts is is proportional to of the distance that exists between the adjacent terminal and said cuts under consideration.

4. A resistor as in claim 3, wherein the contour formed by said rectilinear cuts exhibits the shape of an isosceles triangle whose base coincides with the third edge and whose two equal sides extend from the intersections to said axis of symmetry.

5. A resistor as in any one of claims 1 to 4, wherein one of the cuts that imparts to the resistor its definite value has a length such that the end of said cut is opposite the third edge and does not coincide with said contour.

* * * * *